US007998050B2

(12) United States Patent
De Matteis

(10) Patent No.: US 7,998,050 B2
(45) Date of Patent: Aug. 16, 2011

(54) STRUCTURE OF INTERFOLDING MACHINE WITH ADJUSTABLE CUT-OFF

(75) Inventor: Alessandro De Matteis, Lucca (IT)

(73) Assignee: MTC-Macchine Trasformazione Carta S.R.L., Lucca (IT)

( * ) Notice: Subject to any disclaimer, the term of this patent is extended or adjusted under 35 U.S.C. 154(b) by 0 days.

(21) Appl. No.: 11/675,437

(22) Filed: Feb. 15, 2007

(65) Prior Publication Data

US 2007/0203007 A1 Aug. 30, 2007

(30) Foreign Application Priority Data

Feb. 28, 2006 (EP) ..... 06004052

(51) Int. Cl.
*B31F 5/02* (2006.01)

(52) U.S. Cl. ..... 493/360; 493/413; 493/430; 493/433

(58) Field of Classification Search ..... 493/360, 493/411, 413, 430, 433, 448, 471, 473, 475, 493/477, 478

See application file for complete search history.

(56) References Cited

U.S. PATENT DOCUMENTS 3,229,974 A * 1/1966 Banks ..... 493/359
3,927,875 A * 12/1975 Winnemoller et al. ..... 493/413
4,691,908 A * 9/1987 Bradley ..... 270/21.1
4,861,326 A 8/1989 Kuehner et al.
5,067,698 A 11/1991 Stemmler et al.
5,147,273 A * 9/1992 Rottmann et al. ..... 493/349
5,205,808 A * 4/1993 Gebhardt ..... 493/194
5,310,398 A * 5/1994 Yoneyama ..... 493/430
5,571,069 A 11/1996 Shah et al.
5,980,444 A * 11/1999 Dickhoff ..... 493/433
6,213,927 B1 * 4/2001 De Matteis et al. ..... 493/360
6,228,014 B1 * 5/2001 De Matteis et al. ..... 493/424
6,641,514 B1 * 11/2003 Hechler ..... 493/8
7,060,016 B2 * 6/2006 Cipolli ..... 493/478
2004/0126172 A1 7/2004 Matteis
2005/0070419 A1 3/2005 Haasl
2005/0073090 A1 4/2005 White
2006/0052228 A1 * 3/2006 De Matteis ..... 493/360

* cited by examiner

*Primary Examiner* — Sameh H. Tawfik

(74) *Attorney, Agent, or Firm* — Dennison, Schultz & MacDonald

(57) ABSTRACT

An interfolding machine having a modular structure and with variable cut-off, including a frame having a first plate and a second plate, parallel to each other, interconnected by means of beams. Between the plates are arranged folding rollers, means for moving and an overlap roller. Each plate has a complementary shape to a respective upper plate, with upper plates connected by means of beams among one another. Between the plates, the cutting roller, the transfer roller and the cutter with the blade are arranged, such that a modular portion is formed removable independently from a main portion of the frame. Alternatively, the removable portion can include the only cutting roller and the cutter with the blade.

8 Claims, 7 Drawing Sheets

STRUCTURE OF INTERFOLDING MACHINE WITH ADJUSTABLE CUT-OFF

FIELD OF THE INVENTION

The present invention relates to the production of paper material in stacks of interfolded sheets, and, in particular, it relates to a structure of interfolding machine adapted to process sheets of different length.

BACKGROUND OF THE INVENTION

As well known, in the paper converting industry a variety of types is used of machines and of processes for making paper tissues, paper towels and similar articles in stacks of a certain height of interfolded sheets.

They are obtained stacking the sheets in an "interfolded" way, i.e. at each fold a wing of the previous sheet and a wing of a next stack sheet engage with each other. This way, when drawing a sheet from a package, at the moment of the use, also a wing of a next stack sheet is dragged up to protruding from the package, with subsequent practical employment for certain types of users. Among possible interfolding ways the L-type, with 2 folds (single fold), or the Z or W types, respectively with 3 and 4 folds (multi fold), are known.

The interfolding machines use one or more webs of paper, which from one or more large rollers and which are cut into sheets and then supplied offset with respect to one another on folding counter-rotating rollers.

More precisely, the webs are cut into sheets by means of cutting rollers that interact alternatively, with relative counter-support blades. In case of L-type interfolding the webs are cut to form a shifted succession of sheets coming preferably from two different directions. Then, the sheets coming from either directions are fed in an alternated way to the folding rollers, so that each sheet coming from the first direction is overlapped with a portion of the sheet coming from the second direction, and vice-versa.

The sheets coming from the two directions, in order to be overlapped in the way above described, adhere to the respective folding rollers by a holding system comprising either suction holes or mechanical clamps. Then, the downstream portion of each sheet leaves a respective folding roller at the contact line between the two rollers, held by the other folding roller, which is holding already the upstream portion of the previous sheet.

In case of Z or W type interfolding, or even in case of much more folds, all called "multifold", as disclosed in U.S. Pat. No. 3,490,762 the interfolding method can be similar to what described above, with the difference that The overlapping step between two successive sheets is carried out immediately after the cut and a stream of partially overlapped sheets reaches the folding rollers from a single direction.

The folding rollers have a circumference multiple to the length of the not overlapped portion of two overlapped sheets. Therefore, the stack of sheets adds an interfolded sheet after a fraction of turn of the folding rollers. This parameter determines the size of the folded sheet being stacked, i.e. the width of the interfolded sheets packages. In view of that, one of the parameters of reference for an interfolding machine is the stack width.

Another reference parameter for an interfolding machine is the length of the sheets, also called cut-off. In particular, in the interfolding machines the length of the interfolded sheets that eventually form the stack of final product is responsive to the circumference of the cutting rollers and to the angular distance among the cutting blades. In other words, the cutting length is fixed and is determined univocally by the circumference of the cutting roller or rollers.

By changing the length of the sheets, or cut-off, it is possible to keep the same pack width, by adjusting the number of interfolded panels.

It can be in particular preferable to adjust the cut-off without changing the pack width, leaving the user a variety of choices for making packs.

Machines exist capable of adjusting the cut-off using cutting rollers with several retractable knives (see EP1514677), and that can selectively exit or withdraw thus changing the cutting length: this type of rollers, however, is not appropriate for interfolding machines of "multifold" type, which normally provide one stream of sheets of paper. In fact, in these machines it is not enough to adjust the cut-off by changing only the number of knives, but it would be necessary to change other parts of the machine.

Presently, an interfolding machine of type "multifold" allows to produce interfolded sheets of a single length, with an extremely stiff process, and for each sheet length a different machine is required.

SUMMARY OF THE INVENTION

It is therefore a feature of the present invention to provide an interfolding machine structure that provides to produce stacks of interfolded sheets with sheets of different length even if maintaining, in particular, a same pack width, in an easy and cheap way, causing the whole production process to be flexible and then of differentiating the production.

It is also a feature of the invention to provide a structure of interfolding machine for changing as desired the length of the sheets and the pack width independently.

These and other objects are accomplished by the structure of interfolding machine, according to the present invention, having a frame comprising:

- a feeding section where at least one web of paper is fed at a first speed,
- a cutting section comprising:
  - at least one cutting roller on which at least one blade acts adapted to divide the web of paper into sheets of determined length;
  - at least one transfer roller adapted to convey forward at said first speed the sheets cut in turn by the cutting roller;
- an interfolding section at which the sheets of paper coming from the cutting section travel at a second speed less than the first speed, said interfolding section comprising:
  - means for partially overlapping the sheets suitable to form an overlapped portion between two consecutive sheets exploiting the difference between the first and the second speed,
  - folding means comprising folding rollers, said folding means being adapted to arrange said partially overlapped sheets in a determined interfolded configuration causing the sheets to form underneath a stack of product;
- a separating section where a stack of interfolded sheets is separated from a next stack and withdrawn from the area of process through separating means;
- whose main feature is that said cutting section comprises a portion having a modular structure removable integrally from said frame for being replaced with an equivalent portion but adapted to work with different cut-off.

In particular, the portion of the cutting section that is removable integrally can comprise:

- at least the cutting roller;

at least the transfer roller;

the cutting roller and the transfer roller.

Advantageously, the means for partially overlapping the sheets comprise an overlapping roller adapted to cooperate with the transfer roller. In particular, the transfer roller rotates at the first speed whereas the overlapping roller rotates at the second speed in order to deposit on the overlapping roller the overlapped sheets according to a determined overlapping ratio.

Furthermore, means for moving can be provided adapted to convey the partially overlapped sheets in a zone arranged between the means for overlapping and the folding rollers.

The interfolding machine of modular type can provide a single paper path, where a single web of paper coming from a large roller is cut into sheets that are fed shifted on the counter rotating folding rollers. The overlapping step between two successive sheets is carried out immediately after the cut and the succession of partially overlapped sheets reaches the folding rollers from a single direction.

According to the invention, with a single interfolding machine having more equivalent removable portions, but each portion with rollers of different diameter and then with different cut-off, it is possible to provide stacks of interfolded sheets of different length and then to obtain different interfolding types, i.e. with a different number of portions of overlapped sheets. Therefore, such interfolding machine is highly flexible.

Advantageously, the removable portions, each with rollers of different diameter, are mounted on a automatic introduction/extraction machine, for example a carousel with horizontal axis, capable of receiving more removable portions and introducing/extracting selectively a portion of interfolding machine at a time.

In addition to what above defined, a first removable portion at the cutting section and a second removable portion at the interfolding section can be advantageously provided, said first and said second portion being removable independently. This way, a much more wide variety can be obtained of solutions at the choice of the user to provide an interfolding machine that is highly flexible, with possibility of changing as desired both the length of the sheet and the pack width independently.

Advantageously, the or each removable portion is slidingly mounted on guides arranged longitudinally with respect to the frame.

The removable portion of the interfolding machine comprises preferably two plates, or sides, connected by means of transversal beams that extend parallel to the folding roller, and containing laterally the components of the machine. The frame of the interfolding machine comprises also two sides, each consisting of one or more parallel plates interconnected by means of transversal beams, to which the other components of the machine are connected, at least one of said sides having an opening or a recess with complementary shape for introducing the or each removable portion.

BRIEF DESCRIPTION OF THE DRAWINGS

Further characteristic and the advantages of the interfolding machine, according to the invention, will be made clearer with the following description of an exemplary embodiment thereof, exemplifying but not limitative, with reference to the attached drawings, in which like reference characters designate the same or similar parts, throughout the figures of which.

DESCRIPTION OF A PREFERRED EXEMPLARY EMBODIMENT

Figure 1:
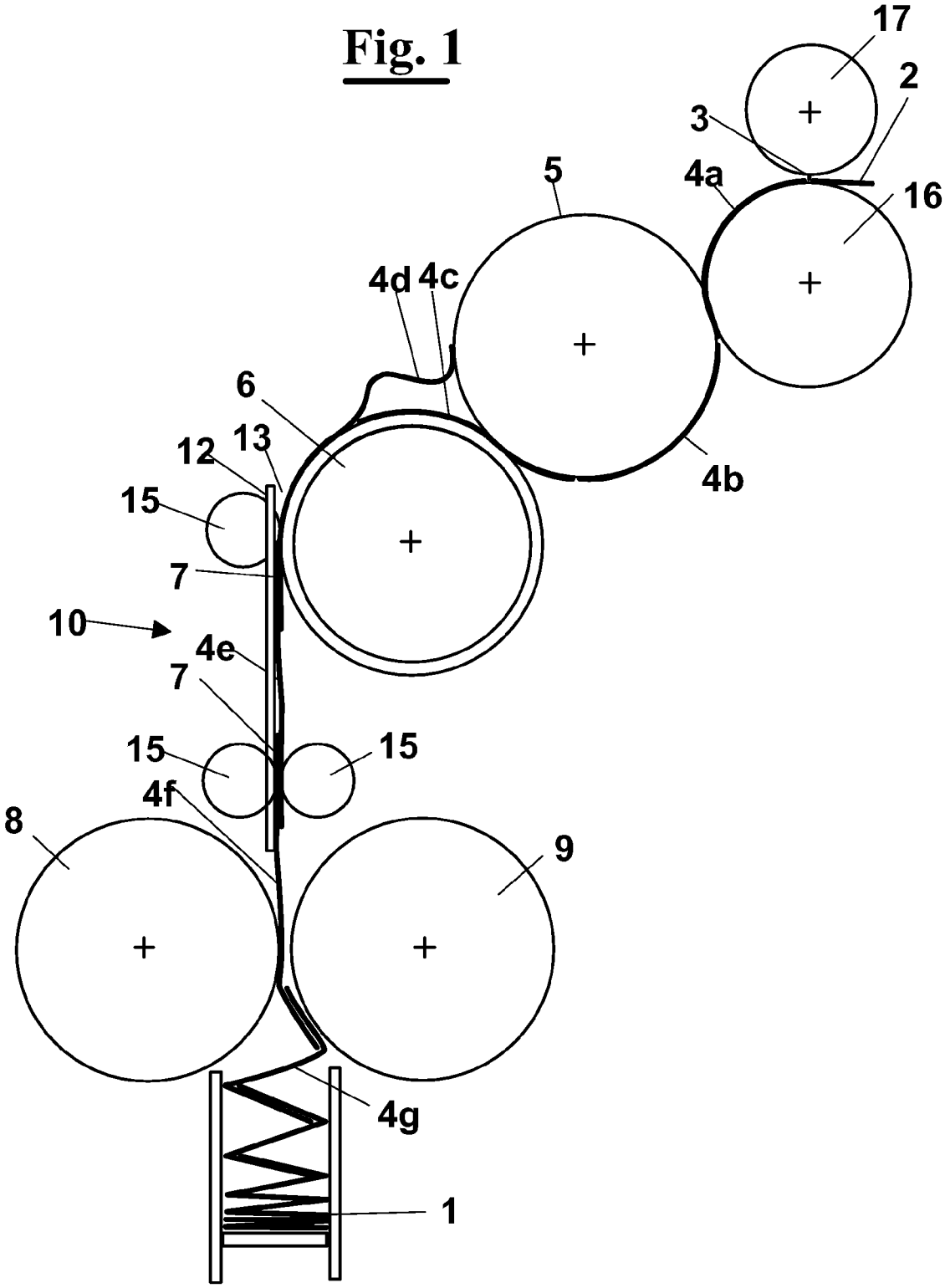
FIG. 1 shows diagrammatically a cross sectional view of an interfolding machine of the type with a single paper path.

With reference to FIG. 1, an interfolding machine of sheet material for making a stack of interfolded sheets 1 uses at least one web 2 of material to interfold, for example paper, non woven fabric fed by means of feeding rollers 41-44. The web 2 is cut by a blade 3 of a cutting roller 17 into sheets of predetermined length. In particular, the blade 3 acts on a cutting roller 16. The cutter, in addition to a roller type, can be also formed without fixed blades and having alternated movement with respect to the cutting roller 16.

The cut sheets, all alike, which are carried along the machine are indicated as 4*a*, 4*b*, 4*c*, 4*d*, 4*e*, 4*f*, 4*g*, starting from the cutting point under the cutter 3 up to the point where they are interfolded.

As well known, at first, the cut sheets 4*a*, 4*b* proceed on a first roller 5 that rotates at a first speed. Then they pass on a second roller 6, called "overlap" roller, which rotates at a second speed less than the first. This way, owing to this speed difference a sheet 4*c* travelling quicker is conveyed under the sheet downstream 4*d* travelling slower, which is raised at the tail by means of air blows not shown. The overlapping portion of the sheets, indicated as 7, between the two sheets 4*c* and 4*d* extends for about a third of their length, in order to form, eventually, an interfolding pattern so-called to Z type, at interfolding rollers 8 and 9, falling on a stack 1.

Among the "overlap" roller 6 and the interfolding rollers 8,9 a conveying system 10 not described in detail is provided, adapted to convey the sheets 4*d*,4*e*,4*f*, partially overlapped, in a corresponding conveying portion. In this section, so-called interfolding section, the sheets travel all at the second speed.

More precisely, the operation of the overlapping system is the following. The overlap roller 6 turns at the second speed, i.e. slower than the transfer roller 5. This causes the sheet 4*c*, transferred by the transfer roller up to overlap roller 6 owing to vacuum systems not shown, to take the shape of a wave. When the tail of the head sheet 4*d*, which is still attached to the transfer roller 5, passes the channel existing between overlap roller 6 and transfer roller 5, the head of the sheet upstream from 4*c* is transferred by the transfer roller 5 to the overlap roller 6 and the overlapping is carried out.

The length of sheets 4*a*-4*g* is determined by the diameter of the cutting roller 16. In order to adjust the length of the sheets, or cut-off, it is necessary to adjust at least the diameter of the cutting rollers 16. This would require however to make, according to the prior art, a very complex and long operation of maintenance, which would require to disassemble large part of the machine.

Furthermore, according to the type of transfer, it could be necessary to change also the transfer roller 5.

Alternatively, in case of cutting rollers with variable cut-off it is necessary to change at least the transfer roller.

Figure 2:
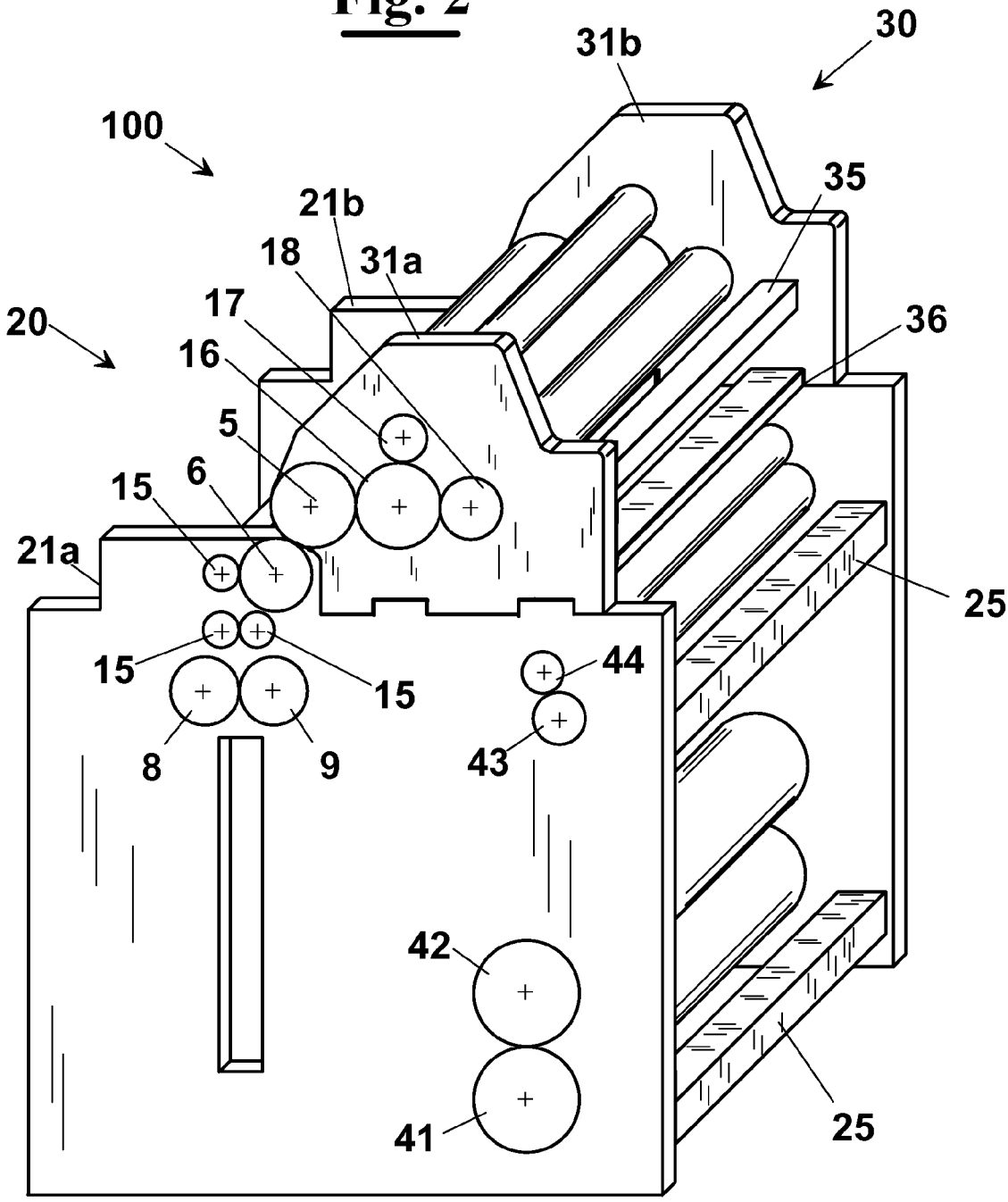
FIG. 2 shows diagrammatically a perspective view of an interfolding machine, according to the invention.

With reference to FIG. 2, an interfolding machine, according to the present invention, has a modular structure, adapted to solve this problem. In particular, the interfolding machine 100 provides a frame 21 (visible alone in FIG. 3) comprising a first plate 21*a* and a second plate 21*b*, parallel to it, interconnected by means of beams 25. Between the plates 21*a* and 21*b* the folding rollers 8 and 9, the means for moving 10 and the overlap roller 6 are arranged.

Each plate 21*a*, or 21*b*, has a complementary shape to a respective upper plate 31*a*, or 31*b*. Upper plates 31*a* and 31*b* shown in figures from 1 to 3 are connected by means of beams 35. Between the plates 31*a* and 31*b*, instead, the cutting roller 16, the transfer roller 5 and the cutter 17 with blade 3 are arranged.

This way, a modular portion 30 is formed that is removable independently from a main portion 20 of the frame.

Obviously, in the essence of the present invention, removable portion 30 can comprise, in a way not shown, only cutting roller 16 and cutter 17 with blade 3. Alternatively, it can comprise only the transfer roller.

The advantage of the invention is that the removable portion brings gearing, bearings, supports, etc. of the replaced rollers and is therefore replaceable with a very short machine stop.

Figure 3:
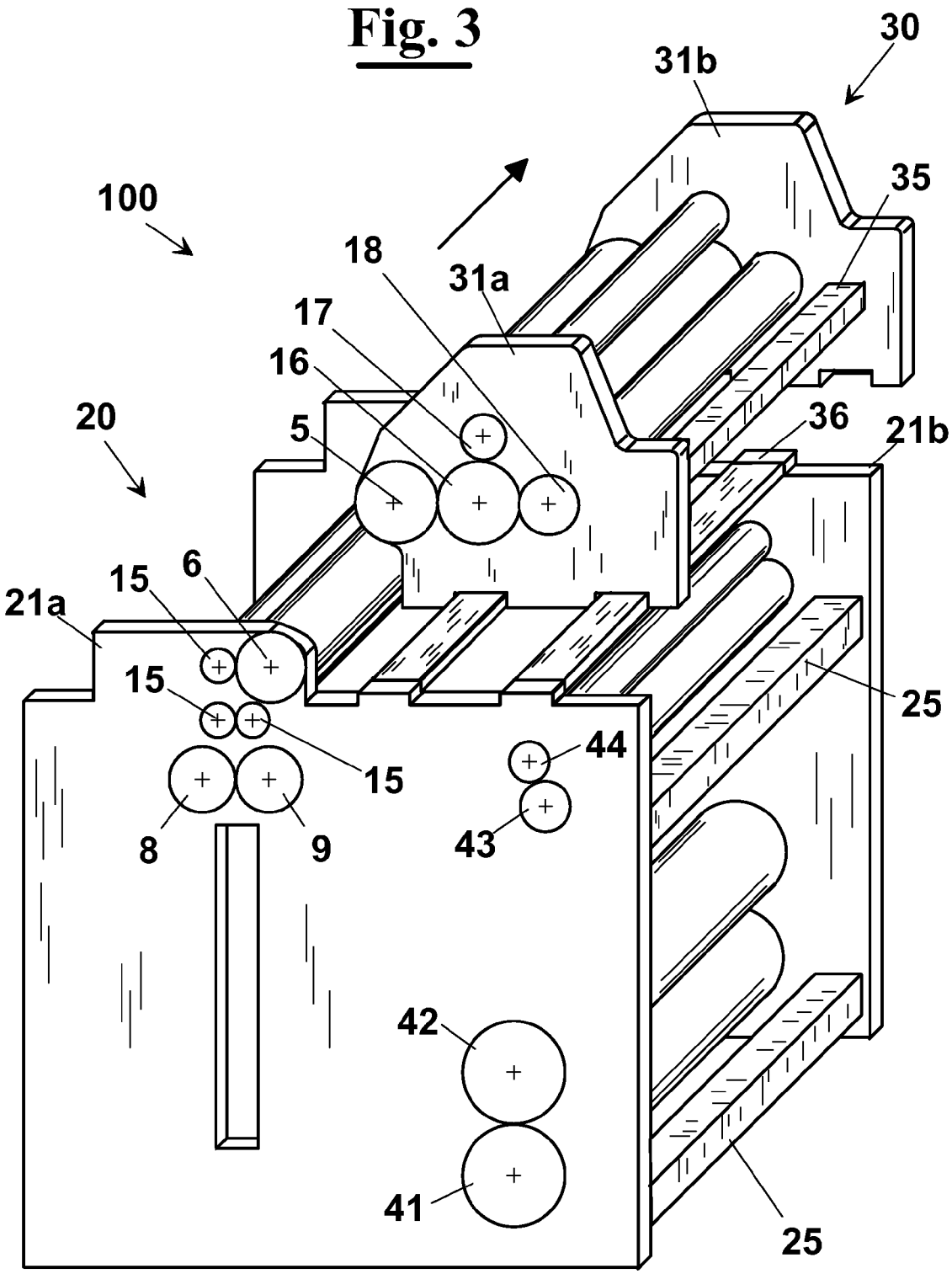
FIG. 3 shows a perspective view of the interfolding machine of FIG. 1 with the removable modular portion in a position of extraction from the working position.
Figure 4:
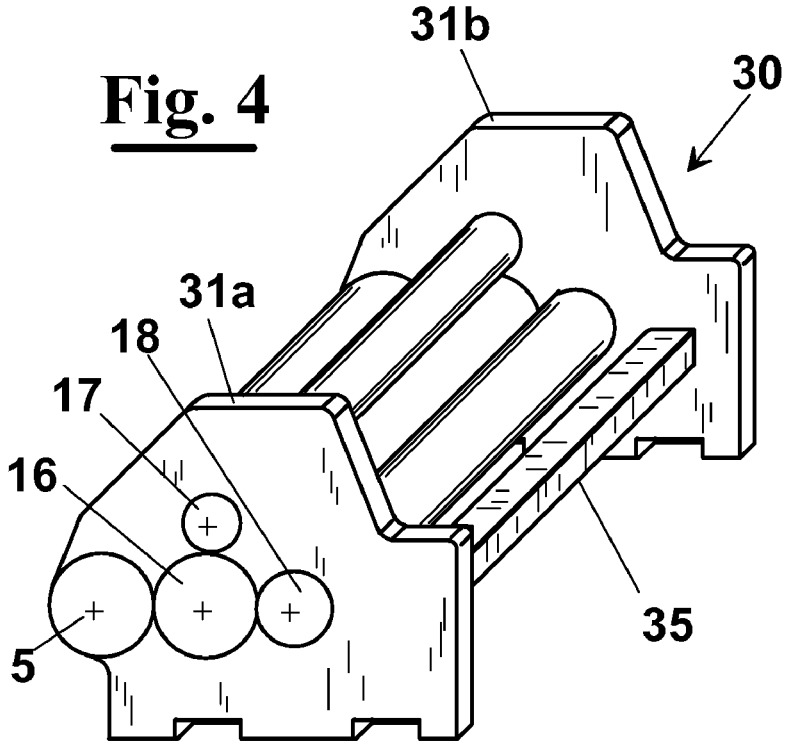
FIG. 4 shows in detail a perspective view of the removable portion.
Figure 5:
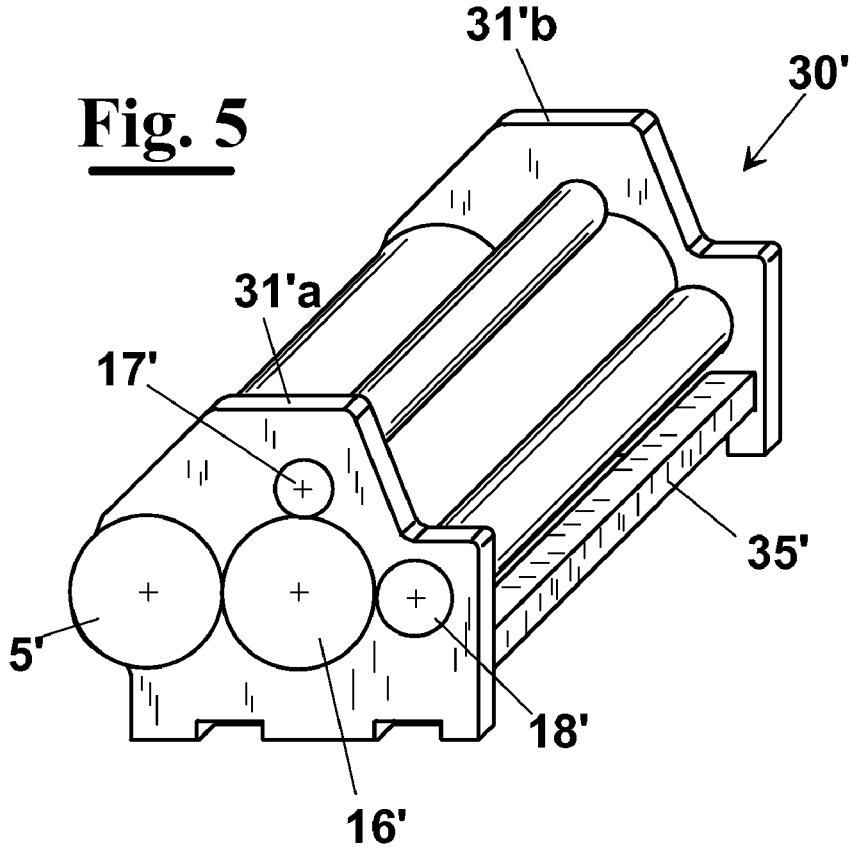
FIG. 5 shows in detail a perspective view of a removable portion equivalent to that of FIG. 4, but with rollers of different dimension.
Figure 6:
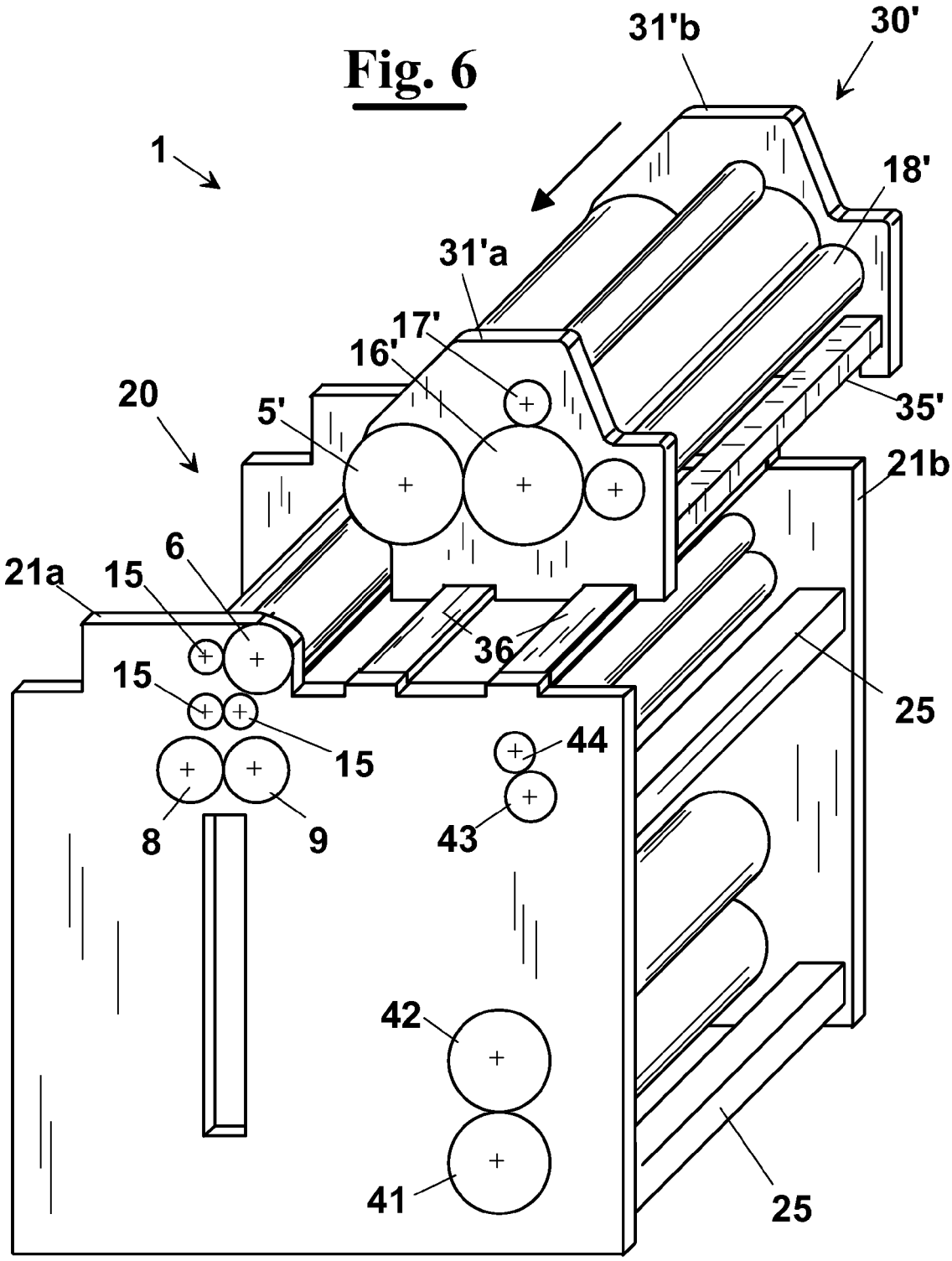
FIG. 6 shows a perspective view of the interfolding machine of FIG. 1 with the removable modular portion of FIG. 5 in a position of introduction into the working position.
Figure 7:
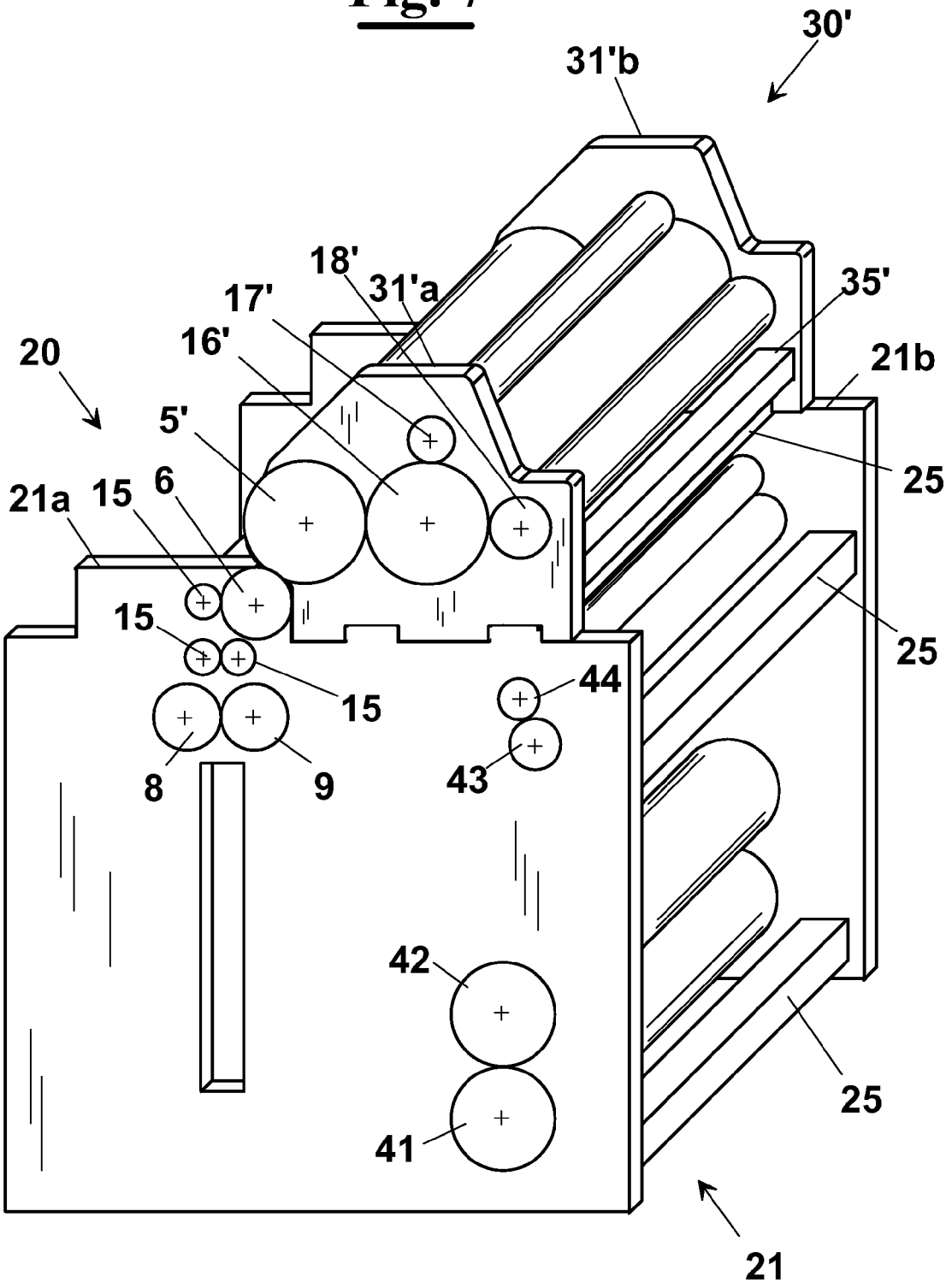
FIG. 7 shows diagrammatically a perspective view of an interfolding machine, with replaced removable modular portion.

The removable portion 30 can be slidingly mounted on a longitudinal guide 36 (FIG. 3). This assists its removal from the working position (FIG. 2), to change it with another removable portion 30' having rollers 16', 17' and 5' of diameter corresponding to the length of the interfolded sheets of the final stack.

As said above, in fact, the length of the interfolded sheets of the final product stack 1 is responsive to the circumference of the cutting roller 16. The modular structure, in the way above described for interfolding machine, allows to replace quickly the cutting roller 16 and/or the transfer roller 5 and then to change the type of the final product.

Figure 8:
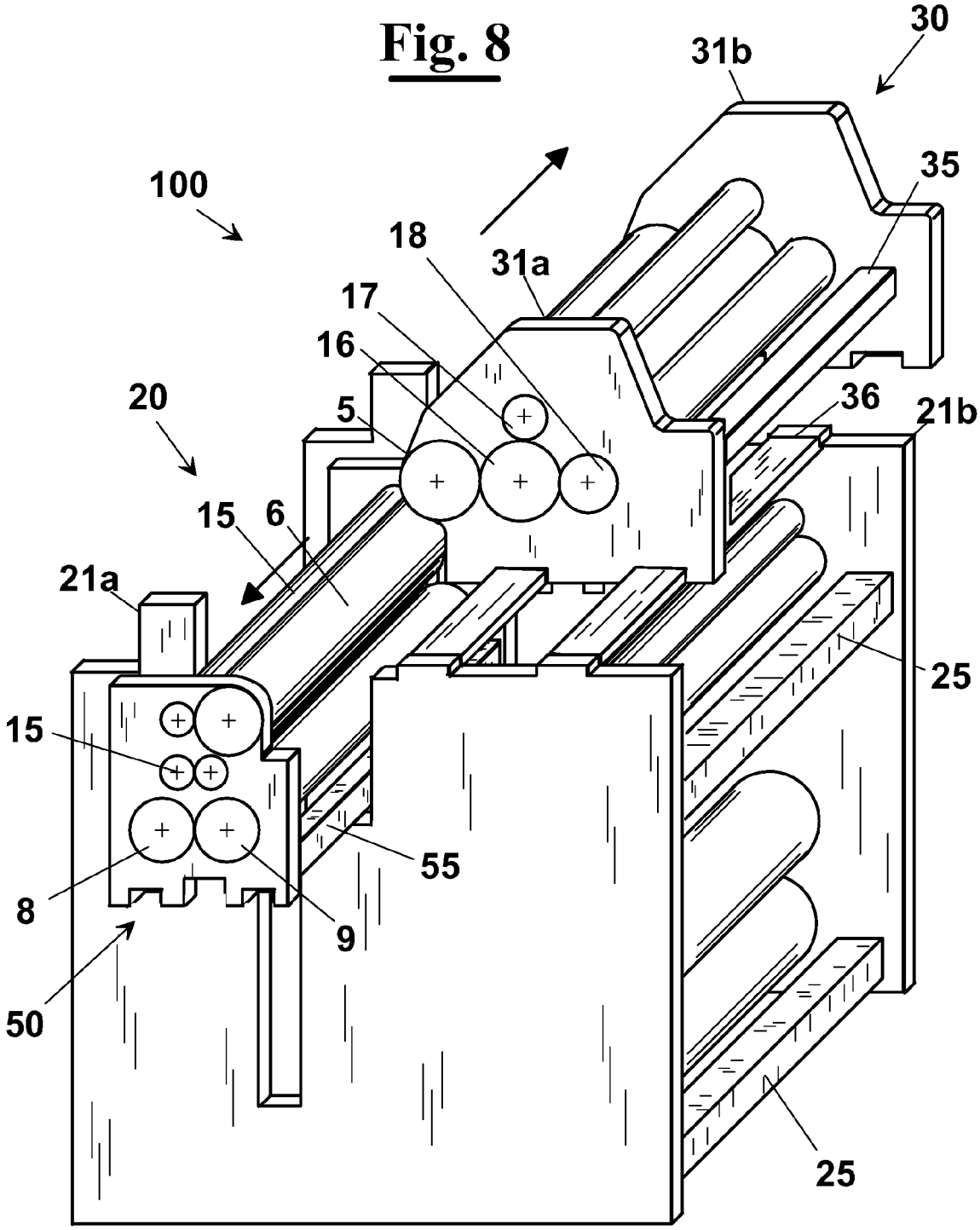
FIG. 8 shows diagrammatically a perspective view of an exemplary embodiment of the interfolding machine of FIG. 1.

In a exemplary embodiment shown in FIG. 8 a second portion 50 is provided removable integrally from the frame of the machine 100. In this case, removable portion 50 comprises the overlap roller 6, the means for moving 15 and the folding rollers 8 and 9. This allows to change at the same time both the length of the sheets and the folding width, i.e. the pack 1 width.

Similarly, to what described for portion 30 also portion 50 can be slidingly mounted on longitudinal guide not shown in FIG. 8.

In a way not shown in the figures, the removable portions 30 and/or 50, each with rollers of different diameter, can be mounted on a automatic introducing/extracting machine, of easy construction by a skilled person, for example a carousel with horizontal axis, capable of receiving more removable portions and extracting selectively a portion of interfolding machine at a time.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

The invention claimed is:

1. A method for adjusting cut-off of an interfolding machine, said interfolding machine having a frame, and comprising a feeding section for receiving at least one web of paper fed at a first speed, a cutting section comprising:

at least one cutting roller on which at least one blade acts to divide the web of paper into sheets of pre-determined length;

at least one transfer roller constructed and arranged to convey forward at the first speed the sheets cut in turn by the cutting roller;

an interfolding section in which the sheets of paper coming from the cutting section travel at a second speed less than the first speed, the interfolding section comprising:

means for partially overlapping the sheets to form an overlapped portion between two consecutive sheets, exploiting the difference between the first and the second speed, folding means comprising folding rollers, said folding means being adapted to arrange said partially overlapped sheets in a determined interfolded configuration causing the sheets to form underneath a stack of product;

a separating section in which a stack of interfolded sheets is separated from a subsequent stack and is withdrawn from a process area by separating means;

wherein said cutting section comprises a removable portion having a modular structure that is removable integrally from said frame of said interfolding machine for being replaced into said interfolding machine with an equivalent portion that is adapted to work with different cut-off, wherein said removable portion comprises:

said at least one cutting roller; or said at least one transfer roller; or said at least one cutting roller and said at least one transfer roller;

and wherein said removable portion comprises two side plates, parallel to each other and interconnected by means of transverse beams parallel to said cutting roller;

said method comprising the steps of:

providing an opening or a recess in said interfoldinq machine with a complementary shape for introducing said removable portion;

providing a plurality of removable portions, each of said removable portions adapted to fit with said complementary shape and having rollers of different diameter, each removable portion having said rollers adapted to cut and convey sheets according to a different cut-off;

removing a current removable portion that is mounted in said interfolding machine having a current cut-off;

selecting from among said plurality of removable portions a desired removable portion having a desired cut-off; and introducing said desired removable portion in said interfolding machine in said opening or a recess with said complementary shape, such that said interfolding machine can operate with said desired cut-off.

2. Method according to claim 1, wherein said transfer roller rotates at a first speed and an overlapping roller rotates at a second speed, such that said transfer roller deposits on said overlapping roller, overlapped sheets according to a determined overlapping ratio.

3. Method according to claim 2, wherein the partially overlapped sheets are conveyed into a portion arranged between said means for overlapping and said folding rollers.

4. Method according to claim 1, wherein said plurality of removable portions are mounted on a automatic introduction/extraction machine, said introduction/extraction machine holding a plurality of removable portions at a time, and selectively removing/introducing, respectively, said current removable portion and said desired removable portion away from/into said interfolding machine.

5. Method according to claim 1, wherein a first removable portion at said cutting section and a second removable portion at said interfolding section are provided, said first and said second portions being removable independently.

6. Method according to claim 1, wherein said removable portion is slidingly mounted on guides arranged longitudinally with respect to said frame.

7. Method according to claim 1, wherein during said removing and introducing steps, said separating means and vertical guides containing said stack slide on carriages that approach and move away from each other along a direction transverse to said frame for arranging the separating means, and vertical guides at an operative distance responsive to roller size.

8. Method according to claim 1, wherein said frame comprises two sides, each comprising at least one parallel plate interconnected by means of transverse beams, to which other components of the machine are connected, at least one of said sides having an opening or a recess with complementary shape for introducing said removable portion, wherein said steps of removing said current removable portion and introducing said desired removable portion is carried out through said opening or recess.

* * * * *